US006880904B2

(12) United States Patent
Masuda

(10) Patent No.: US 6,880,904 B2
(45) Date of Patent: Apr. 19, 2005

(54) INK JET RECORDING APPARATUS

(75) Inventor: Kazunori Masuda, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/133,331

(22) Filed: Apr. 29, 2002

(65) Prior Publication Data

US 2002/0171695 A1 Nov. 21, 2002

(30) Foreign Application Priority Data

May 15, 2001 (JP) ..... 2001-144795

(51) Int. Cl.[7] ..... B41J 29/38
(52) U.S. Cl. ..... 347/5; 347/9; 347/192
(58) Field of Search ..... 347/9, 14, 190, 347/191, 192, 19, 5; 323/322, 345; 400/124.16

(56) References Cited

U.S. PATENT DOCUMENTS 5,190,383 A * 3/1993 Suzuki et al. ..... 400/124.16
5,257,156 A * 10/1993 Kirkpatrick ..... 361/18
5,519,417 A * 5/1996 Stephany et al. ..... 347/14
5,594,489 A * 1/1997 Nagano ..... 347/211

FOREIGN PATENT DOCUMENTS

JP 2000-102248 4/2000

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

An ink jet recording apparatus, having a control circuit for controlling the driving of a recording head and a driver circuit for driving the recording head, includes an AC/DC converting circuit for converting an input AC voltage into a first DC voltage to then supply the first DC voltage to the driver circuit, and a voltage converting circuit for converting the first DC voltage into a second DC voltage to then supply the second DC voltage to the control circuit, and when the AC voltage is interrupted, for keeping the second DC voltage higher than a reset voltage of the control circuit until the first DC voltage drops to at least a guarantee voltage of the recording head.

12 Claims, 10 Drawing Sheets

INK JET RECORDING APPARATUS

BACKGROUND OF THE INVENTION

1. Field of the Invention

The present invention relates to a control circuit for conducting control to protect a recording head of an ink jet recording apparatus when the power for a power supply circuit thereof is interrupted.

2. Description of the Related Art

A power supply (power supply unit or power supply circuit) of an ink jet recording apparatus (printer) needs to supply at least two voltages, one for driving a recording head and the other for operating a driver circuit (control circuit). Said power supply is required to prevent, for example, disconnection in the driver circuit by dropping the voltage for driving the recording head before the voltage for the driver circuit drops if an input power supply (commercial power supply) is turned OFF during recording, for example.

The electronic components such as a CPU or an IC used in such a control circuit have a lowest voltage at which they are guaranteed to operate. At a voltage below this guarantee voltage, such CPU or IC will be reset. As a result, the motor or the recording head of the apparatus may malfunction in some cases.

To guard against this, as mentioned above, typically the control circuit is devised to prevent these components from malfunctioning upon voltage drop due to power-OFF or power interruption. One example of such a device may be a reset function, by which the CPU or IC is initialized when the voltage of the control circuit reaches a reset voltage. By this initialization, such device as a motor or recording head can be entered into a safe state.

The conventional printer power supply has a multiple-output configuration for obtaining a plurality of outputs on the side of the secondary winding of a converting transformer of a switching power supply, in which the output of these which is used for driving a recording head is in some cases provided with an output ON/OFF switch for using a control signal (ON/OFF signal) sent from the side of the apparatus to turn ON/OFF the supply of power in order to save on power dissipation in the standby state of the apparatus or to preserve safety in an event where a service person or a user has touched the apparatus.

To stabilize the voltage applied on the recording head, the power supply circuit of such a printer adds capacitance by use of an electrolytic capacitor to the apparatus and the vicinity of the recording head. Such a capacitor needs to be large in capacitance to accommodate an improvement in the performance of the printer.

For this purpose, such a configuration is implemented that a discharge circuit is provided so that if the input power supply is interrupted, immediately after the voltage on the driver circuit drops to reset the components, the output side of the switch may be discharged of the capacitance load, to drop the voltage on the recording head instantaneously in order to prevent disconnection etc. thereof.

The operating waveform of the output voltage in such a case is shown in FIG. 8. In FIG. 8, V1 indicates the recording head driving voltage and V2, the driver circuit voltage.

A suggestion for protecting the recording head further is disclosed in Japanese Patent Publication No. 2000-102248. The configuration of a power supply circuit according to said suggestion is shown in FIG. 10 and its operating waveform, in FIG. 9.

If, during the operation of an apparatus using this switching power supply device, supply of the input power is stopped by breaking of the input switch, for example, when the plug of the apparatus is pulled out accidentally, the second output V2 has roughly a constant current value (rated current value) no matter whether the apparatus is operating or not, so that the output voltage drops readily.

To guard against this, a detector circuit 18 is provided for detecting a drop in the primary-winding side rectified voltage (Vin) before the second output voltage V2 starts to drop. When the detector circuit 18 detects a drop in a voltage Vin to then output a detection signal, correspondingly said first ON/OFF switching circuit 19 is forcedly turned OFF and, at the same time, an output voltage discharge circuit 20 is turned ON. By this process, the voltage at the first output terminal can be dropped instantaneously no matter whether a load current is flowing or not.

As indicated by the waveform of FIG. 9, this circuit has such a characteristic that as the DC voltage Vin on the primary-winding side capacitor drops gradually upon interruption of the supply of power, with the switching operation continuing by the switching power supply, an output ON/OFF switch 3 is forcedly turned OFF before the output voltage drops below a rated value (moment t0), to release the load capacitance.

By this process, even before the value of the second output V2 starts to drop, at any value of the rated load current of each output the head driver power supply voltage V1 can be dropped to thereby lower the head driving voltage V1 down to a safe voltage Vsafe at a timing (Trst), at which the voltage V2 drops to a reset voltage.

As such, a circuit shown in FIG. 10 constitutes power supply means for preventing disconnection etc. of a circuit in the recording head by dropping the recording head driving voltage before the voltage on the driver circuit is reset.

Recently, however, the printer has been improved in performance and an electrolytic capacitor used therein has been increased in capacitance. To drop the head driving voltage rapidly against load of this large capacitance, it is necessary to discharge the head in a large current instantaneously. For this purpose, the switching elements and peripheral components for discharge must have a very large value of allowable power. Moreover, a discharge circuit and an input power supply-interruption detecting circuit must be added to the switching power supply circuit, to complicate the configuration of the power supply circuit and increase the number of necessary components, the area for mounting these, and the volume of the power supply circuit, thus increasing also the manufacturing costs.

SUMMARY OF THE INVENTION

In view of the above, it is an object of the present invention to provide an ink jet recording apparatus that has no discharge circuit nor input power supply-interruption detecting circuit but has a power supply circuit which can accommodate an improvement in performance of a printer and protection requirements for the recording head thereof.

To solve the above problems, an ink jet recording apparatus having a control circuit for controlling the driving of a recording head and a driver circuit for driving a recording head according to the present invention comprises:

an AC/DC converting circuit for converting an input AC voltage into a first DC voltage to then supply said first DC voltage to the driver circuit; and a voltage converting circuit for converting the first DC voltage into a second DC voltage to then supply said second DC voltage to the circuit control and also, upon interruption of the AC voltage, keeping the second DC voltage higher than a reset voltage of the control circuit until the first DC voltage drops down to a guarantee voltage of the recording head.

DESCRIPTION OF THE PREFERRED EMBODIMENTS

Figure 11:
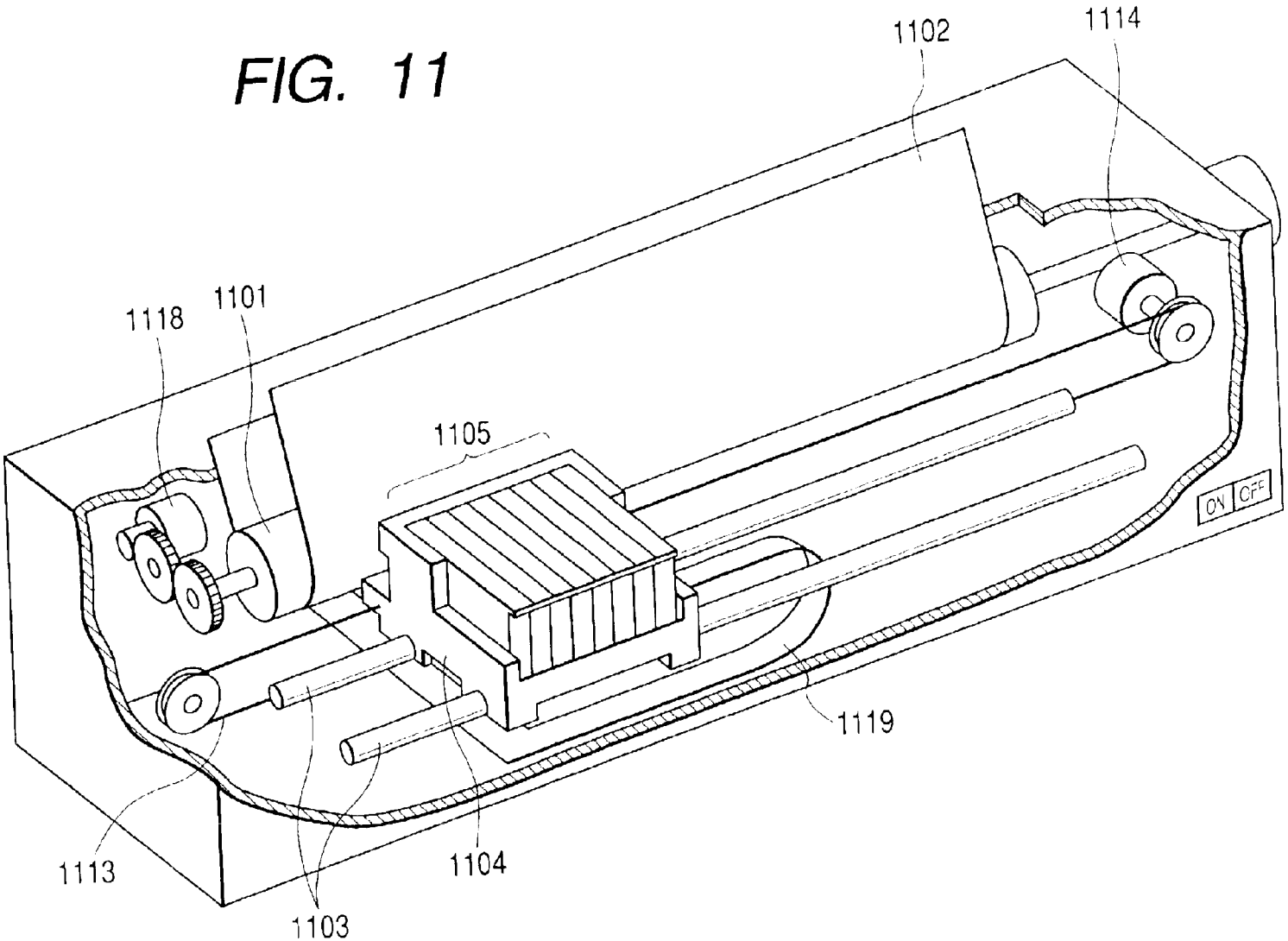
FIG. 11 is a perspective view for showing an ink jet recording apparatus to which the present invention can be applied.

The following will describe preferred embodiments of the present invention. FIG. 11 is a perspective view for showing a configuration example of an important part of a serial type printer given as an ink jet recording apparatus to which the present invention can be applied. A reference numeral 1105 indicates a recording head, which can be mounted on a carriage 1104 to reciprocate longitudinally along a shaft 1103. Ink ejected from the recording head arrives at a recording medium 1102 the recording surface of which is restricted by a platen 1101 with a minute gap being placed with respect to the recording head, thus forming an image thereon.

The recording head is supplied through a flexible cable 1119 with an ejection signal according to image data. Note here that a reference numeral 1114 indicates a carriage motor for permitting scanning by the carriage 1104 along the shaft 1103. A reference numeral 1113 indicates a wire for transmitting a driving force from the motor 1114 to the carriage 1104. Moreover, a reference numeral 1118 indicates a feed motor which is coupled with a platen motor 1101 to thereby carry the recording medium 1102.

First Embodiment

Figure 1:
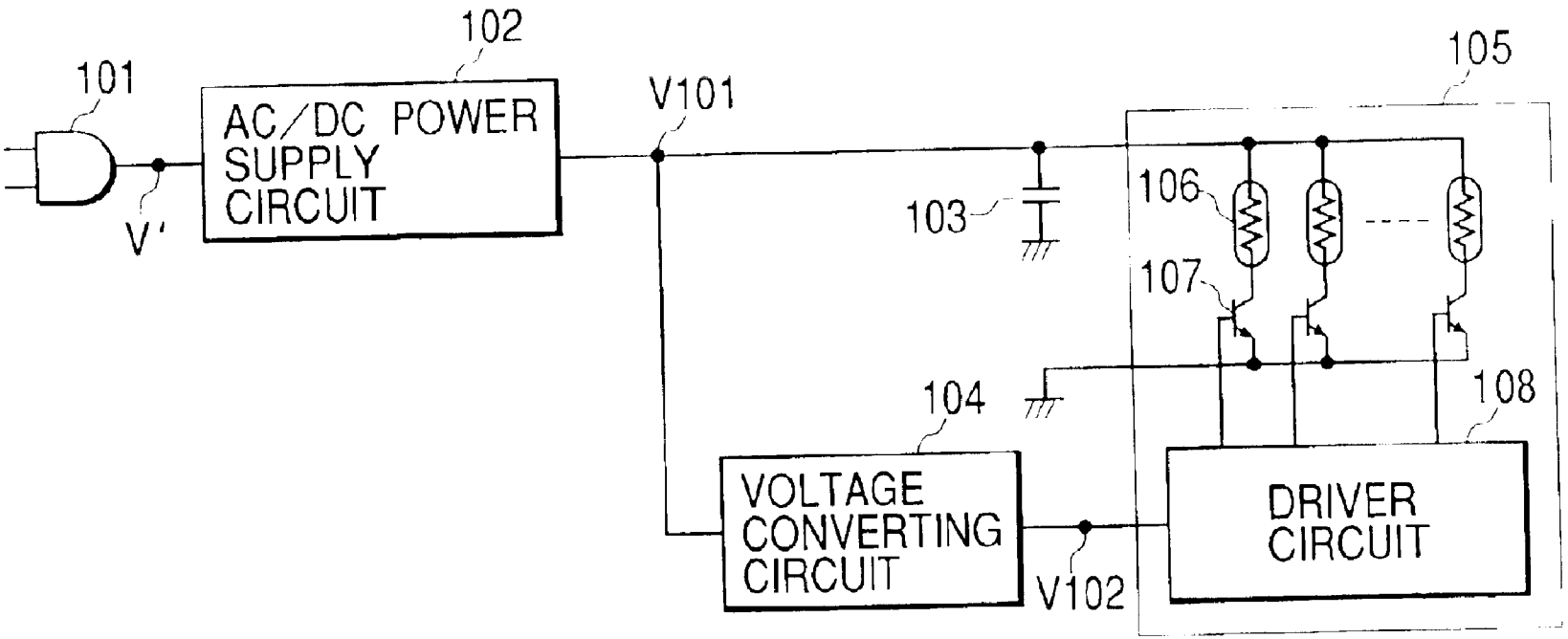
FIG. 1 is a block diagram for showing a configuration of a first embodiment.

FIG. 1 is a block diagram for showing a configuration of power supply means of a printer according to the first embodiment. A reference numeral 101 indicates a commercial power supply input terminal and a reference numeral 102 indicates an AC/DC power supply circuit for converting an AC voltage into a DC voltage etc. This AC/DC circuit has a constant voltage circuit for detecting a secondary-winding side voltage to compare it to a reference potential and then feed back a comparison signal to the primary-winding side.

A reference number 103 indicates a capacitor added to stabilize the recording head driving voltage. The capacitor 103 is connected in parallel with the recording head driving circuit.

A reference numeral 104 indicates a voltage converting circuit for converting a DC voltage output from the AC/DC power supply circuit into a predetermined voltage, which is supplied to the driver circuit (control circuit) for controlling the recording head.

A reference numeral 105 indicates the recording head, a reference numeral 106 indicates a resistor (electric thermal converter) for heating ink contained in the recording head, a reference numeral 107 indicates a switching element for controlling continuity to said resistor, and a reference numeral 108 indicates a control circuit for logically controlling the driving of the switching element. Hereinafter, this control circuit is called a driver circuit.

A voltage of V101 (24 volts, which is written as 24V hereinafter) is applied to drive the recording head, while a driving voltage of V102 (five volts, which is written as 5V hereinafter) is applied to the driver circuit. The voltage converting circuit 104 receives an input power supply from the output of the AC/DC supply circuit, to convert the voltage V101 into the voltage V102. This voltage V102 is supplied to the driver circuit 108.

Typically, the AC/DC power supply circuit 102 has a smoothing electrolytic capacitor on the primary-winding side for smoothing a commercial power supply input and also enjoys the operations of the constant voltage circuit for constant voltage control, so that its output voltage can be kept at a constant value for a predetermined period t0 (a few tens of milliseconds) without dropping immediately even upon interruption of the input voltage.

Figure 7:
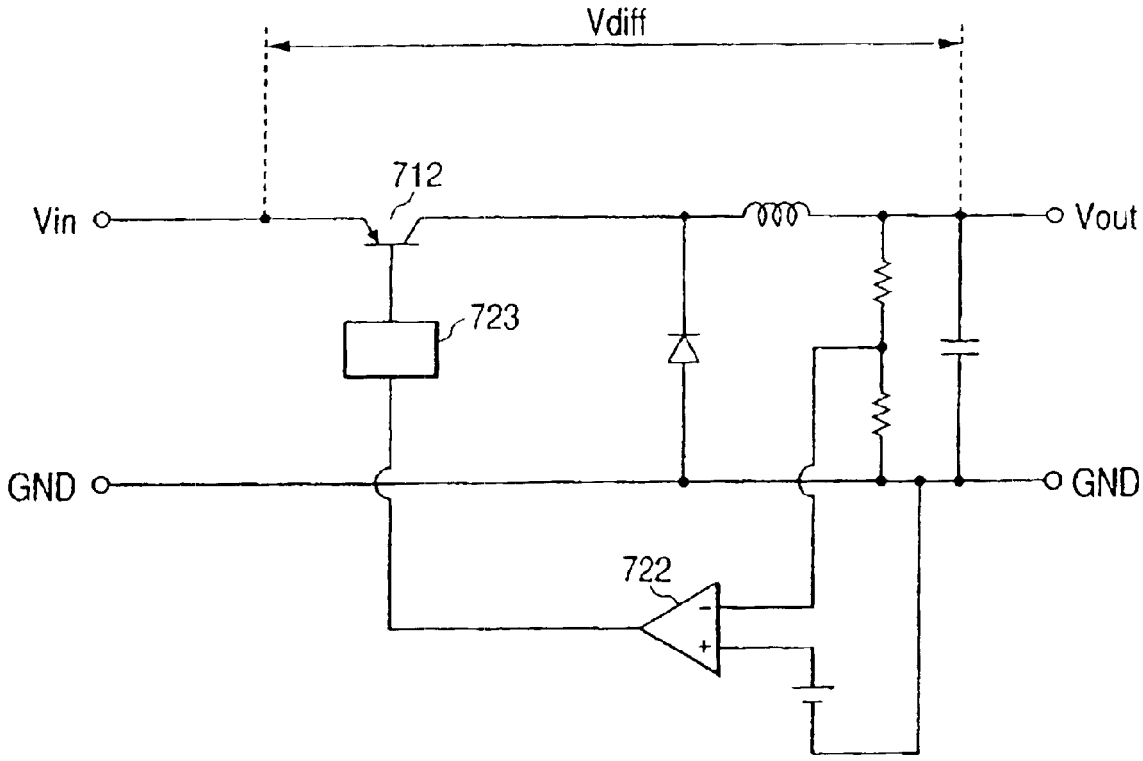
FIG. 7 is a circuit diagram for showing a voltage converting circuit of the first through third embodiments.
Figure 8:
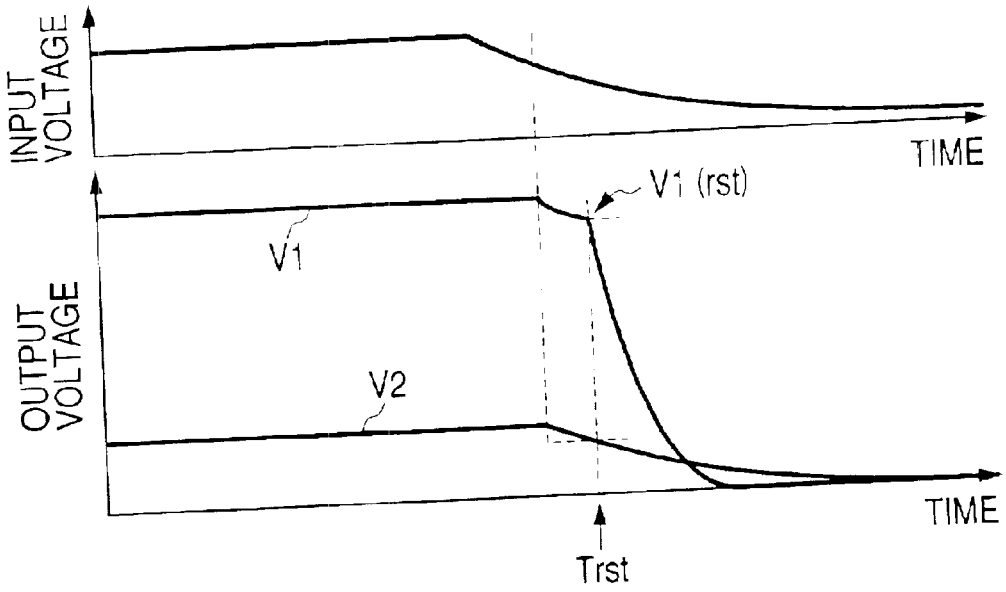
FIG. 8 is a graph for showing an output voltage waveform of a conventional example.
Figure 9:
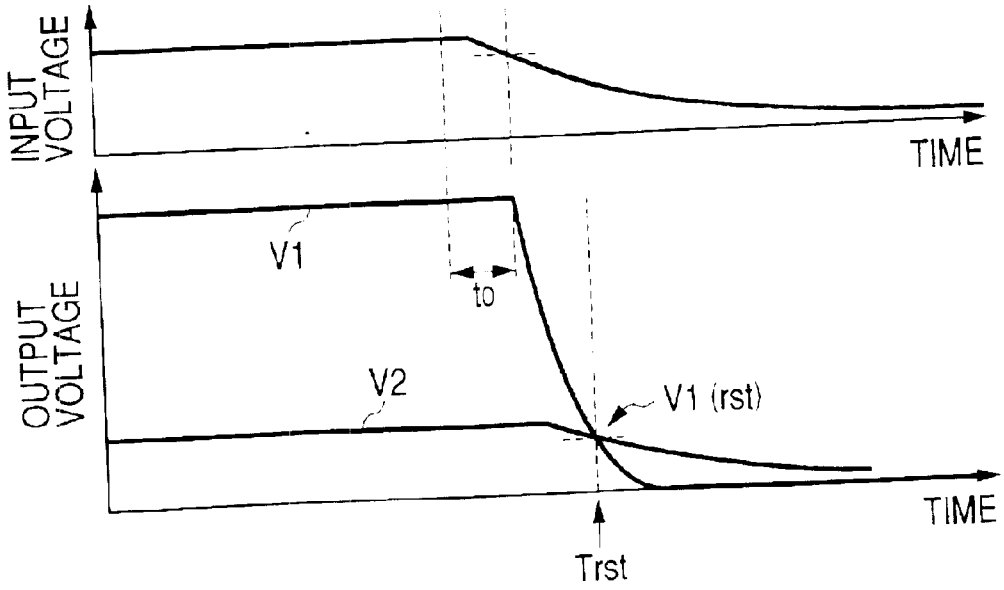
FIG. 9 is another graph for showing the output voltage waveform of the conventional example.
Figure 10:
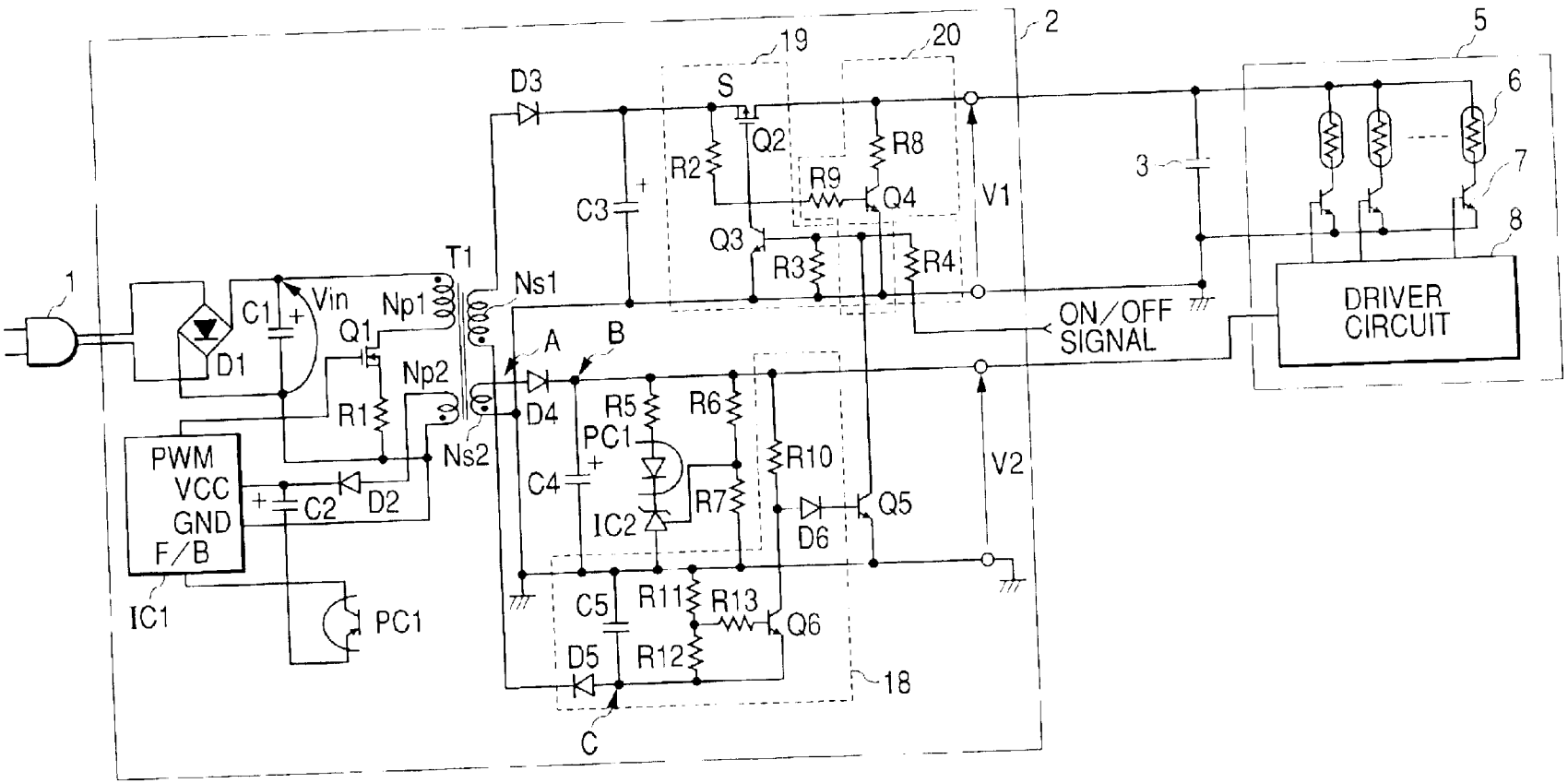
FIG. 10 is a circuit diagram for showing an output voltage waveform of the conventional example.

FIG. 7 is a circuit diagram for showing a basic configuration of the voltage converting circuit 104. In the figure, an output voltage Vout is detected by a comparator 722 for an increase/decrease of its own, a comparison result of which is sent to a pulse width control circuit 723, which then controls a ratio of the ON/OFF times of a control transistor 712, thus stabilizing the voltage Vout at a predetermined potential. Vdiff indicates a minimum voltage between the input and the output, being two volts (hereinafter written as 2V). A relationship among the voltages Vin and Vout and the ON time ton of the control transistor 712 is Vout/Vin=ton/T. In this expression, T indicates a switching period, being in a relationship of T=ton+toff (toff: OFF time of control transistor).

If the voltage Vin drops, the ON time ton of the control transistor 712 is prolonged and, if the voltage Vin rises, the ON time ton of the control transistor 712 is shortened, thus controlling the voltage Vout at a constant value.

Furthermore, as far as the condition of (Vin>rated output voltage (5V)+Vdiff) is satisfied, the voltage Vout can be kept at a rated voltage value.

Figure 4:
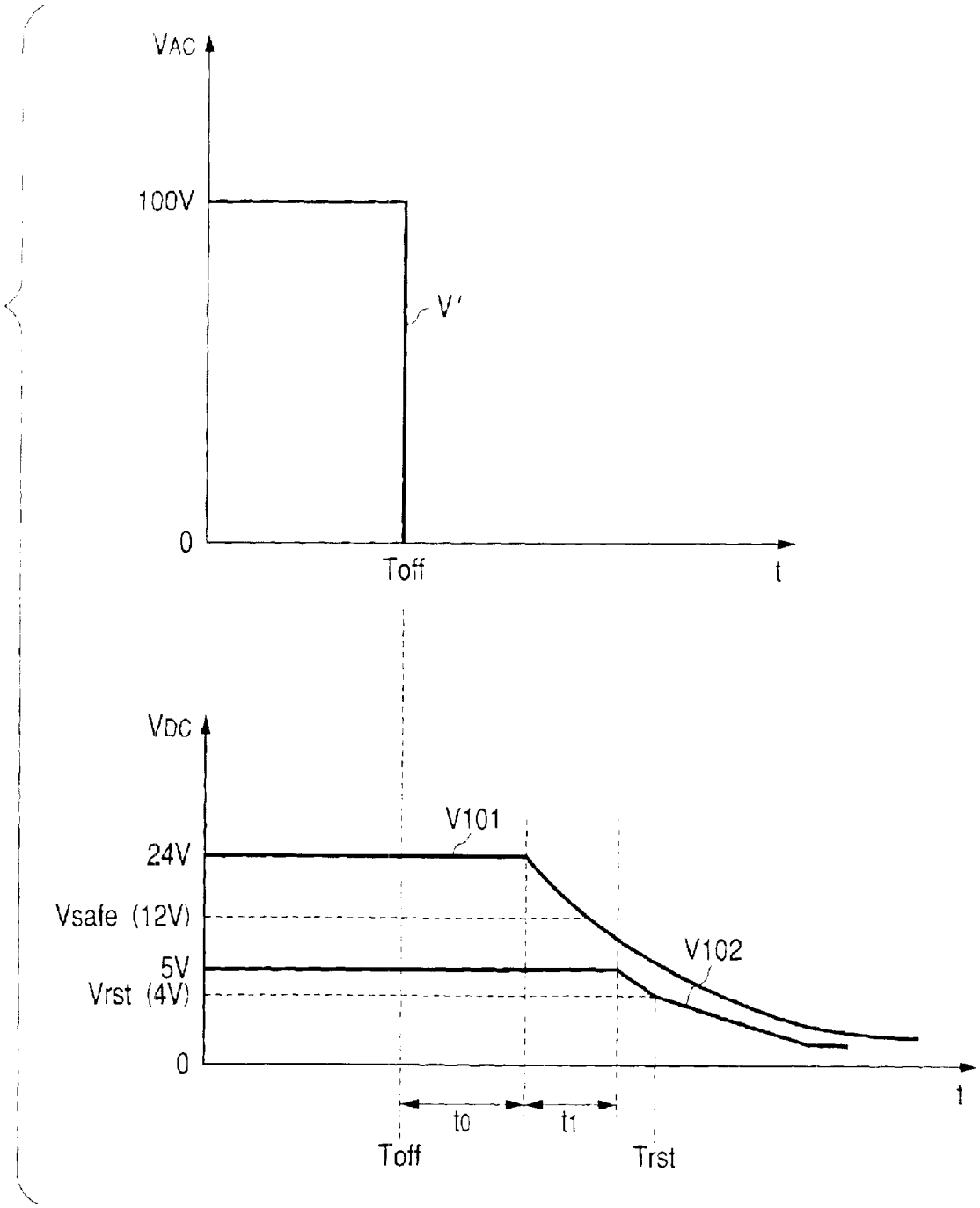
FIG. 4 is a graph for showing an output voltage waveform of the first embodiment.

FIG. 4 shows graphs for showing waveforms of the output voltages. The graphs show the recording head driving voltage V101 and the driver circuit operating voltage V102, respectively, when an input voltage V' such as a commercial power supply or the like is interrupted abruptly during printing.

The voltage V101 does not immediately drop in potential even when the input voltage V' is interrupted and drops down to 0 volt (hereinafter written as 0V) and is kept at a rated output voltage value of 24V for a predetermined period t0 (a few tens of milliseconds).

Then, when the predetermined period t0 expires, the output voltage V101 starts to drop from 24V. For a predetermined period t1 in which the conditions of (Vin>rated output voltage (5V)+Vdiff) is satisfied, however, the V102 is kept at the rated output voltage (5V) by the ON/OFF control of the control transistor 712 (switching element) in the voltage converting circuit 104.

Then, the output voltage V102 starts to drop. At the timing Trst, the output voltage V102 becomes a reset voltage Vrst of the driver circuit, to reset it. At this moment, the voltage V1 continues to drop below the guarantee voltage Vsafe. At this guarantee voltage Vsafe, the driver circuit of the recording head is guaranteed not to fail.

Even if the output voltage V102 drops further to such an extent that the driver circuit may be unstable, the recording head driving voltage applied on the heater resistor is still lower than the guarantee voltage Vsafe (12 volts, which is written as 12V hereinafter), thus avoiding bringing about a failure such as disconnection in the recording head driving circuit.

Although this embodiment has employed a step-down chopper regulator as the voltage converting circuit 104, the present invention is not limited thereto; for example, it may be a three-terminal regulator, which is typical of the series regulator.

As mentioned above, even if the input voltage such as a commercial power supply is interrupted abruptly, such a printer power supply circuit as having a simple configuration can prevent the recording head from failing. By this configuration, the volume of the power supply circuit can be reduced by ⅓ through ¼, thus compacting the power supply and decreasing the manufacturing costs.

Second Embodiment

Figure 2:
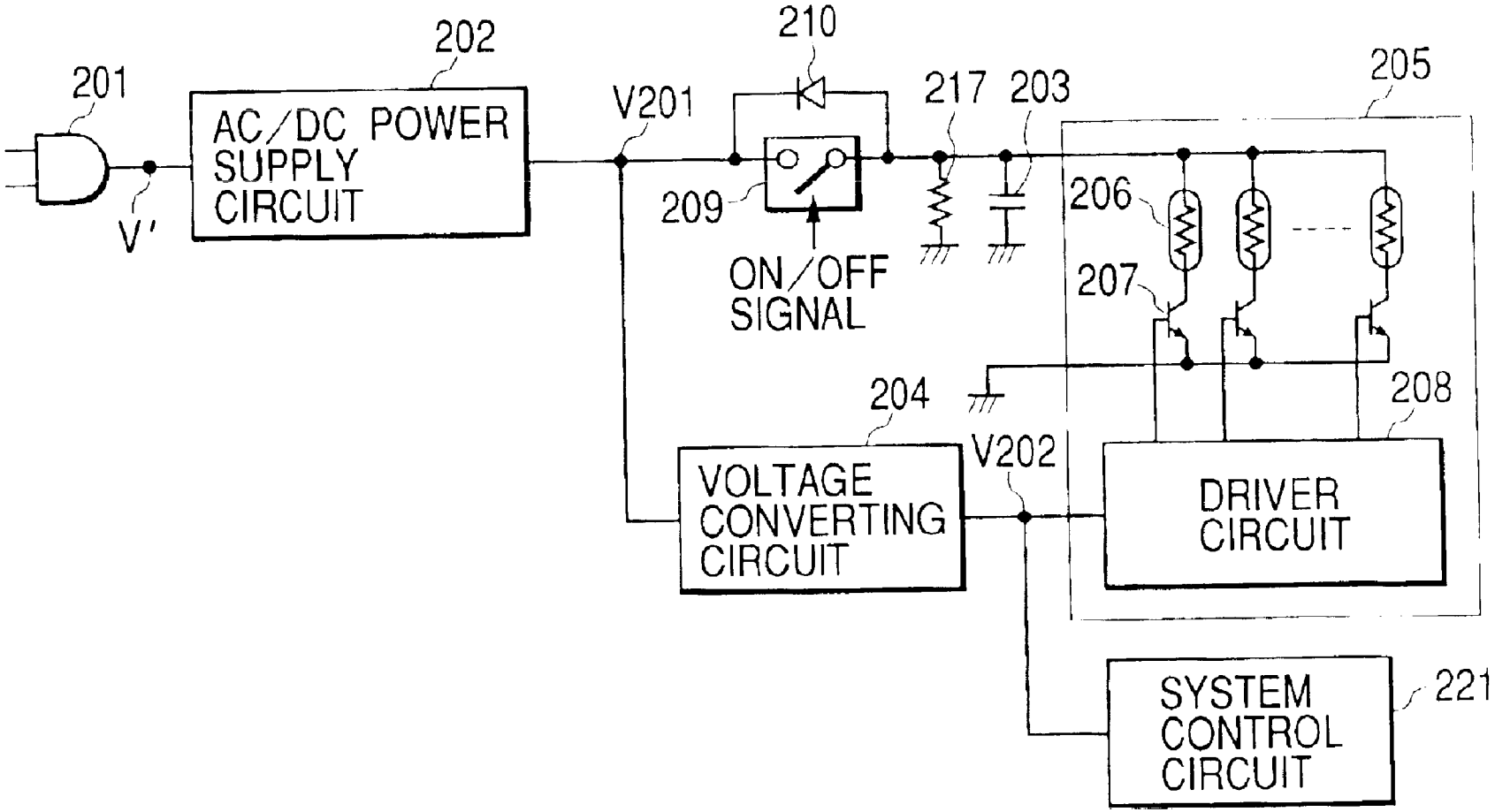
FIG. 2 is a block diagram for showing a configuration of a second embodiment.

FIG. 2 shows a configuration of the second embodiment. This configuration differs from that of the first embodiment in that a switch 209, a diode 210, a resistor 217, and a system control circuit 221 are added. The explanation of the recording head and the voltage converting circuit already described with the first embodiment is omitted here.

The system control circuit 221 serves to control the operations of the carriage and also the paper feed operations in the printer. This system control circuit incorporates therein a CPU and memories such as a ROM and a RAM.

The voltage converting circuit 204 receives an input from the stage preceding the input switch 209, to provide a supply voltage to the driver circuit and the system control circuit.

The recording head driving voltage is controlled by turning the switch 209 ON/OFF using a control signal (ON/OFF signal) sent from the system control circuit 221.

For example, if the CPU incorporated in the system control circuit 221 decides that the printer is in the standby state, it outputs the OFF signal to turn the switch 209 OFF. Thus, it is possible to preserve safety in an event that the service person or the user touches the driving-system components in maintenance etc. and also to save on power dissipation.

In a case where a typical printer is operating, if the switch 209 is turned OFF, the capacitor 203 connected parallel in the circuit at the output terminal of the recording head driving power supply is discharged of the electric charge accumulated thereon through the resistor 217, thus dropping in output voltage.

In an event where the input voltage such as a commercial power supply etc. is interrupted, if the switch 209 is a unilateral element, for example, a thyristor or bipolar-transistor, the input voltage of the switch 209 may in some cases drop faster than the output voltage thereof depending on the operating state of the recording head.

To guard against this, such a current path is provided in parallel with the switch 209 as to continue electrically when the output voltage becomes higher than the input voltage so that these voltages may be roughly equal to each other.

This current path consists of the diode 210, which has its cathode connected to the input of the switch and its anode connected to the output thereof, thus implementing the above-mentioned operations.

Furthermore, if the switching element consists of a MOS_FET, a diode (body diode) built in it constitutes the current path, thus providing the same operations as those by the case of connecting a diode externally.

Figure 5:
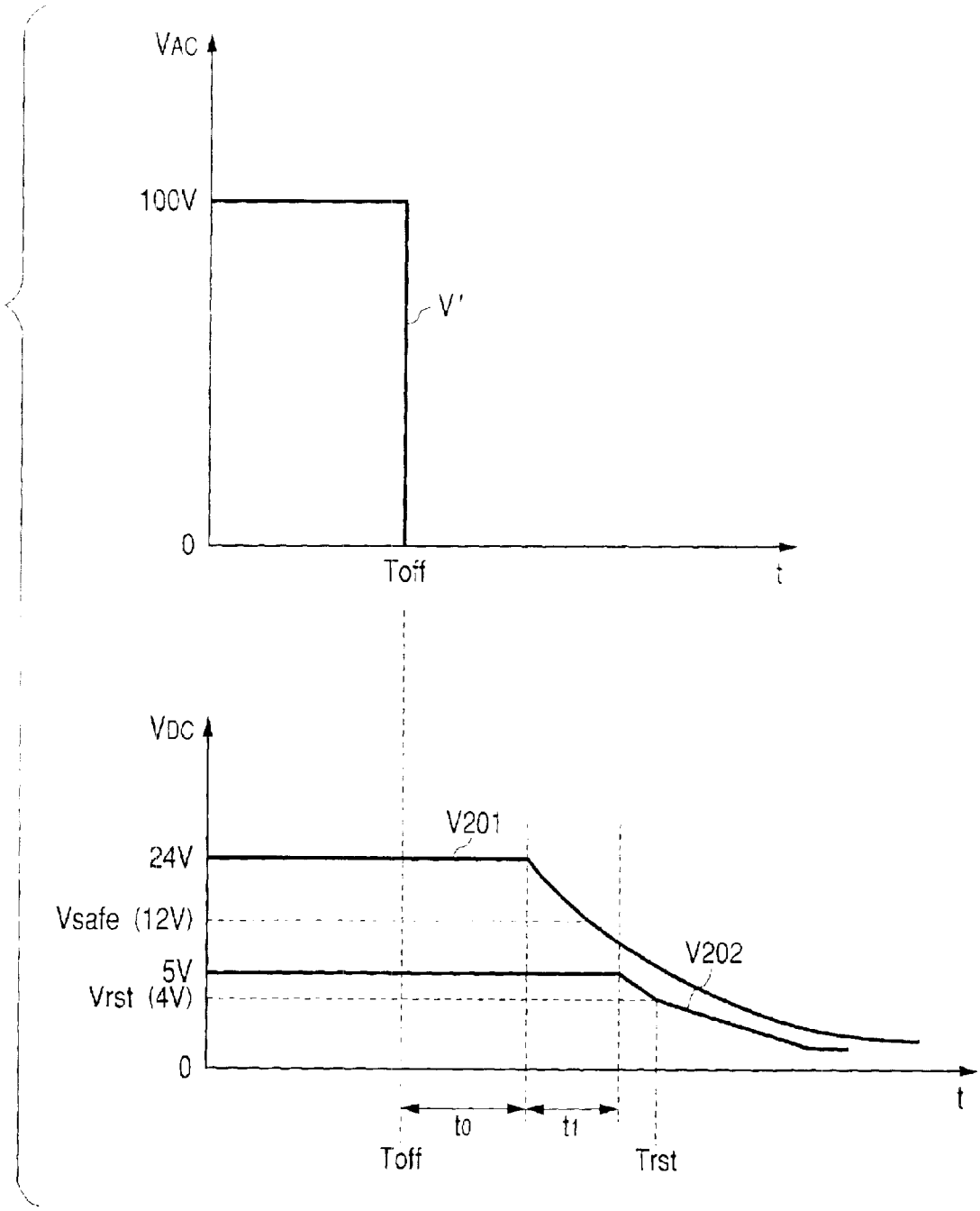
FIG. 5 is a graph for showing an output voltage waveform of the second embodiment.

FIG. 5 shows graphs indicating how the output of the recording head driving voltage V201 (24V) and the driver circuit operating voltage V202 (5V) change, respectively, if the input voltage V' such as a commercial power supply or the like is interrupted abruptly when the printer is operating. Being omitted in explanation, the change in voltage of FIG. 5 is the same as that of FIG. 4; in fact, at the timing Trst the output voltage of the driver circuit becomes Vrst, to reset it. At this moment, the voltage V201 is already less than the guarantee voltage Vsafe.

Note here that when the switch 209 is OFF, no voltage is applied on the head.

This configuration gives the effect mentioned with the first embodiment as well as an effect of preserving safety in an event that the service person or the user touches the driving circuit in maintenance etc.

Third Embodiment

Figure 3:
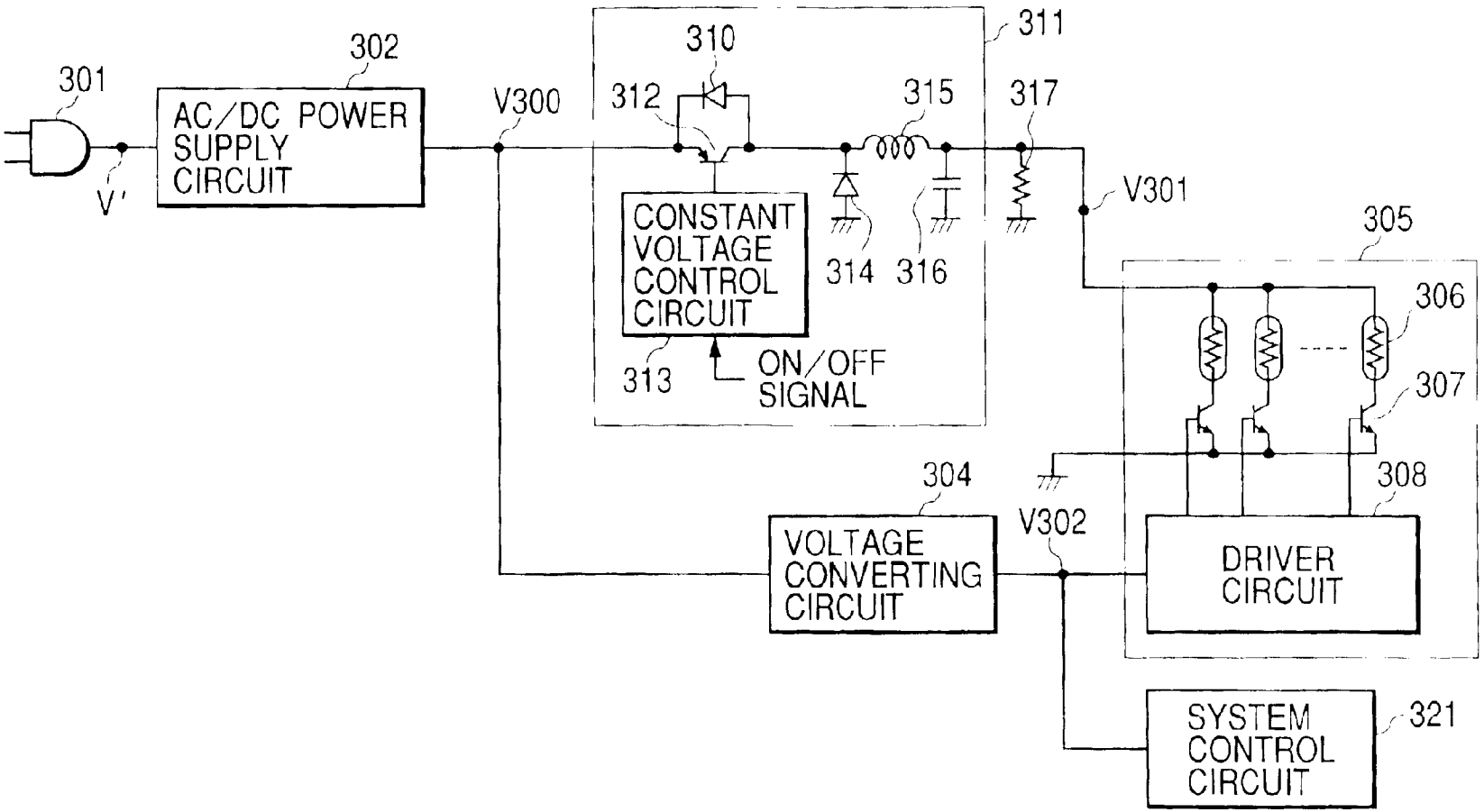
FIG. 3 is a block diagram for showing a configuration of a third embodiment.

FIG. 3 shows a configuration of the third embodiment. This configuration differs from that of the first embodiment in that a voltage converting circuit 311, a resistor 317, and a system control circuit 321 are added. The recording head, the voltage converting circuit, and the system control circuit described with the first and second embodiments are not explained here.

A reference numeral 311 indicates the voltage converting circuit for generating a recording head driving voltage. A reference numeral 312 indicates a switching element in the voltage converting circuit, a reference numeral 313 indicates a constant voltage control circuit for turning this switching element ON/OFF to thereby stabilize the output voltage of the voltage converting circuit 311, a reference numeral 314 indicates a flywheel diode, a reference numeral 315 indicates a choke coil, a reference numeral 316 indicates a smoothing capacitor, and a reference numeral 317 indicates a discharging resistor for use in an ordinary operation.

In this embodiment, the voltage converting circuit 311 is provided for converting an output voltage V300 (30 volts, which is written as 30V hereinafter) of an AC/DC power supply circuit 302 into a recording head driving voltage V301 (24V). Further, such a function is provided as to provide ON/OFF control on the voltage output of this voltage converting circuit 311 based on a control signal (which enables the voltage output when in the ON state and disables it when in the OFF state) output from the CPU incorporated in the system control circuit 321.

Note here that since the voltage V301 is used to drive the recording head at a required high voltage accuracy, the output voltage of the voltage converting circuit 311 has also a high accuracy (for example, ±1%). The voltage V300 (30V), on the other hand, needs only to have a required voltage accuracy of, for example, ±5%, so that the AC/DC power supply circuit 302 outputs a voltage at a voltage accuracy of ±5%.

The input of a voltage converting circuit 304 for generating the driver circuit operating voltage V302 is connected to the output voltage V300 for the AC/DC circuit 302.

Like in the case of the second embodiment, when the CPU incorporated in the system control circuit 321 outputs the OFF control signal, the voltage converting circuit 311 stops in operation to turn OFF the output, so that a smoothing capacitor 316 in the voltage converting circuit 311 is discharged of the charge accumulated thereon through the resistor 317, thus lowering the output voltage. The smoothing capacitor 316 plays also the roles of the capacitor of the first embodiment and the capacitor 203 of the second embodiment.

When the output voltage V300 (30V) of the AC/DC power supply circuit is lowering due to interruption of the input voltage V' such as a commercial power supply etc., the output voltage V301 of the voltage converting circuit 311 for the recording head driving power supply may in some cases be kept at a higher voltage than the input voltage V300 owing to the charge accumulated on the smoothing capacitor 316 depending on the operating state of the recording head.

To guard against this, a diode 310 is inserted in parallel with the switching element 312 in the voltage converting circuit 311 in such a manner that a cathode of the diode is connected to the input side and an anode thereof is connected to the output side of the switching element 312. In this configuration, when the output voltage V301 is higher than the input voltage V300, a current flows through the diode so that the output voltage V301 and the input voltage V300 may be roughly equal to each other.

Furthermore, if the switching element consists of a MOS_FET, a diode (body diode) built in it constitutes the current path, thus eliminating the necessity of connecting an external diode.

Figure 6:
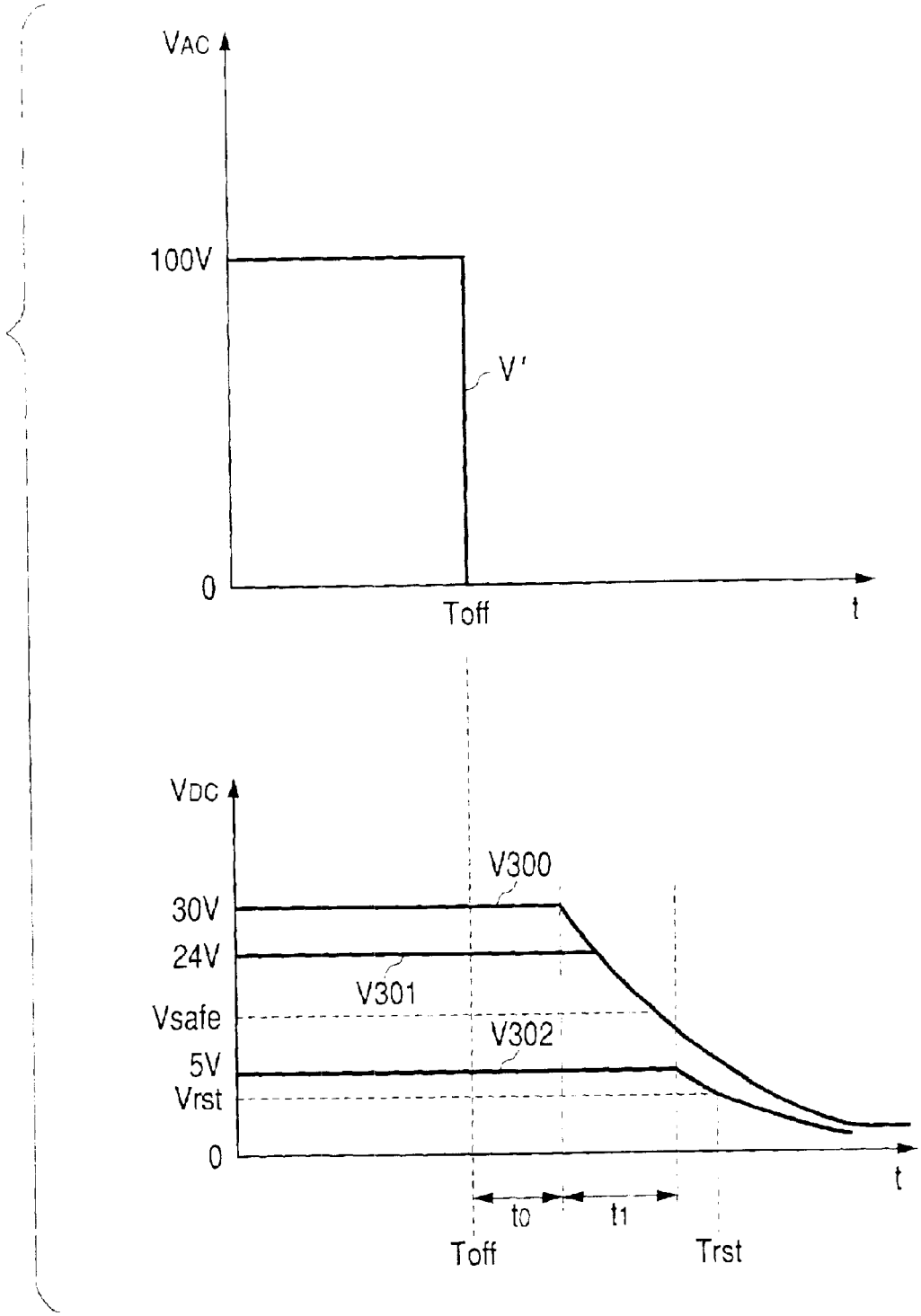
FIG. 6 is a graph for showing an output voltage waveform of the third embodiment.

FIG. 6 is a graph for showing an output voltage waveform of the circuit configuration shown in FIG. 3. FIG. 6 shows graphs indicating how the voltage V300 (30V) of the AC/DC power supply circuit 302, the voltage V201 (24V) for driving the recording head, and the voltage V302 (5V) for operating the driver circuit and the system control circuit change if the input voltage V' such as a commercial power supply etc. is interrupted abruptly when the printer is operating.

Even when the input voltage V' is interrupted to become 0V, the output voltage V300 does not readily drop but is kept at a rated output voltage value of 30V for a predetermined period t0 (a few tens of milliseconds). For this predetermined period t0 (a few tens of milliseconds), the voltage V301 is also kept at a rated output voltage value of 24V.

After the predetermined period t0 elapses, the output voltage V300 starts to drop. The V301 also starts to drop. The V302, however, is kept at the rated voltage value of 5V for a predetermined period in which the condition of (Vin>rated output voltage (5V)) is satisfied.

Then, the output voltage V302 starts to drop. And, at the timing Trst the output voltage becomes Vrst, to reset the driver circuit. At this moment, the voltage V1 is less than the guarantee voltage Vsafe already.

This configuration thus makes it possible to reduce the manufacturing costs and protect the recording head, as described with the first and second embodiments.

Furthermore, the AC/DC power supply circuit 302 can be used to drive the carriage motor or the feed motor. Such a power supply for the motors can be implemented inexpensively without requiring such a high voltage accuracy as that for the power supply for driving the recording head.

In addition, the voltage converting circuit 311 can be disposed separately from the AC/DC power supply circuit 302. This gives some degree of freedom in design for placing it near the recording head as much as possible. This in turn makes it possible to compensate for a drop in voltage owing to the wiring from the voltage converting circuit up to the recording head, thus supplying power to the recording head at a higher voltage accuracy.

Although the above first through third embodiments have been described with reference to, especially, such a type of printer system as to employ means (for example, electric thermal converter) for generating thermal energy as the energy utilized to eject ink to then use said thermal energy in order to change the state of the ink for improvements in recording density and fineness, the present invention is not limited thereto; for example any other system may be employed such as a piezo-electric system.

Although a serial type has been employed as one example of the recording apparatus embodiment, the present invention is not limited thereto; for example, the apparatus may use a full-line type recording head having a length corresponding to the width of the largest recording medium that can be recorded by the printer.

Furthermore, although in the second and third embodiments the CPU in the system control circuits 221 and 321 decides a standby state of the printer to thereby turn OFF the switch 209 and the switching element 312 respectively, the present invention is not limited thereto; for example, these switch 209 and switching element 312 may be turned OFF when an abnormality is detected such as an abnormal rise in temperature of the recording head. Alternatively, they may be turned OFF by operating a service switch.

In addition, the above-mentioned values need not be used exclusively as the values of the output voltage of the AC/DC power supply circuit or the voltage of the system control circuit. For example, a voltage value of 3.3V or 1.8V may be used for the driver circuit or the system control circuit.

The reset voltage Vrst of the control circuit is not limited to four volts (4V) but may take on any value as long as it matches a parameter of the circuit. Moreover, the safety voltage Vsafe is not limited to the value of 12V but may take on any value as long as it matches the driving characteristics or the circuit configuration of the recording head. The value of the minimum voltage between the input and the output is also not limited to 2V.

The timings t0, t1, and Trst for a change in voltage are also not limited to the above-mentioned values, but may take on any value as long as it matches in control the combinations of the circuit components and their characteristics.

Furthermore, the voltage accuracy at which the AC/DC power supply circuit or the voltage converting circuit provide an output voltage is not limited to the values described in the above-mentioned embodiments.

As described above, the present invention makes it possible to reduce the costs and save on the space of the power supply circuit while implementing a circuit configuration for preventing a failure of the recording head in a power supply circuit of an ink jet recording apparatus.

What is claimed is:

1. An ink jet recording apparatus for executing recording by using a recording head, said recording head having a driver circuit for controlling the driving of said recording head, the ink jet recording apparatus comprising:

a system control circuit for determining the status of said ink jet recording apparatus and for controlling said ink jet recording apparatus;

an AC/DC converting circuit for converting an input AC voltage into a first DC voltage to then supply the first DC voltage to said recording head;

a voltage converting circuit for converting the first DC voltage into a second DC voltage to then supply the second DC voltage to said driver circuit and said system control circuit, and for keeping the second DC voltage higher than a reset voltage of said driver circuit at least until the first DC voltage drops to a guarantee voltage of said recording head;

switching means connected to a supply line of the first DC voltage, the supply line connecting the AC/DC converting circuit with said recording head, said switching means disconnecting the connection of the supply line of the first DC voltage on the basis of an OFF signal output when said system control circuit determines a predetermined status;

a diode connected in parallel with said switching means in such a manner as to have a cathode thereof connected to a terminal at said AC/DC converting circuit side of said switching means and an anode thereof connected to a terminal at the recording head side of said switching means; and a capacitor connected to the supply line of said first DC voltage between said recording head and said switching means.

2. The ink jet recording apparatus according to claim 1, wherein said voltage converting circuit has a switching element so that a ratio of an ON time/OFF time of said switching element may be controlled to stabilize the second DC voltage.

3. The ink jet recording apparatus according to claim 1, further comprising an electrothermal converter for generating thermal energy to eject ink.

4. An ink jet recording apparatus according to claim 1, wherein the predetermined status is that the ink recording apparatus is in a standby state.

5. An ink jet recording apparatus according to claim 1, wherein the predetermined status is that the ink jet recording apparatus is in an abnormal state.

6. An ink jet recording apparatus for executing recording by using a recording head, said recording head having a driver circuit for controlling the driving of said recording head, the ink jet recording apparatus comprising:

a system control circuit for determining the status of said ink jet recording apparatus and for controlling said ink jet recording apparatus;

an AC/DC converting circuit for converting an input AC voltage into a first DC voltage;

a first voltage converting circuit for converting the first DC voltage into a second DC voltage to then supply the second DC voltage to said driver circuit and said system control circuit, and for keeping the second DC voltage higher than a reset voltage of said driver circuit at least until the first DC voltage drops to a guarantee voltage of said recording head; and a second voltage converting circuit for converting the first DC voltage into a third DC voltage to then supply said third DC voltage to said recording head, said second voltage converting circuit having:

switching means;

a constant voltage control circuit for switching said switching means on the basis of an OFF signal output when said system control circuit determines a predetermined status;

a diode connected in parallel with said switching means in such a manner as to have a cathode thereof connected to a terminal at said AC/DC converting circuit side of said switching means and an anode thereof connected to another terminal; and a smoothing capacitor.

7. The ink jet recording apparatus according to claim 6, further comprising an electrothermal converter for generating thermal energy to eject ink.

8. An ink jet recording apparatus according to claim 6, wherein the predetermined status is that the ink recording apparatus is in a standby state.

9. An ink jet recording apparatus according to claim 6, wherein the predetermined status is that the ink jet recording apparatus is in an abnormal state.

10. The ink jet recording apparatus according to claim 6, wherein said first voltage converting circuit has a switching element so that a ratio of an ON time/OFF time of said switching element may be controlled to stabilize the second DC voltage.

11. The ink jet recording apparatus according to claim 6, wherein a discharging resistor is connected between said second voltage converting circuit and said recording head.

12. The ink jet recording apparatus according to claim 6, further comprising a motor for a recording operation, and a motor AC/DC converting circuit that supplies a voltage for driving the motor, wherein a voltage accuracy output by said second voltage converting circuit is higher than that output by said motor AC/DC converting circuit.

* * * * *